United States Patent [19]

Blackman

[11] Patent Number: 4,850,529

[45] Date of Patent: Jul. 25, 1989

[54] TUBE CONSTRUCTION FOR FOOD AND BEVERAGE TRAY

[75] Inventor: Stephen M. Blackman, Westmont, Ill.

[73] Assignee: Federal Paper Board Company, Inc., Montvale, N.J.

[21] Appl. No.: 73,436

[22] Filed: Jul. 15, 1987

[51] Int. Cl.[4] ..... B65D 5/48

[52] U.S. Cl. ..... 229/904; 229/120.31; 206/563; 206/170

[58] Field of Search ..... 229/904, 41 R, 41 B, 229/120.08, 120.31; 220/23.83, 23.86; 206/170, 175, 193, 199, 200, 557, 565, 563

[56] References Cited

U.S. PATENT DOCUMENTS

| | | | |
|---|---|---|---|
| 3,009,623 | 11/1961 | Wenzel | 206/563 |
| 3,400,875 | 9/1968 | Coe | 229/904 |
| 3,722,781 | 3/1973 | Page et al. | 206/563 |
| 3,780,906 | 12/1973 | Katzenmeyer | 206/170 |
| 4,156,484 | 5/1979 | Wischusen | 229/904 |
| 4,511,042 | 4/1985 | Wischusen, III | 229/904 |

*Primary Examiner*—Willis Little

*Attorney, Agent, or Firm*—Charles E. Brown; Charles A. Brown

[57] ABSTRACT

A tray particularly useful by fast food establishments and the like for serving various products. The tray is formed from a tube formed in a flat state for storage and shipment and being readily erectible. A central portion of the top of such tube is provided with suitable product receiving openings which may open into a receptacle or which receive drink cups. At one or more ends of the tray, there is a compartment which is defined by an end of the initial tube which is pivoted from a longitudinal position to an upstanding position. The tray may have one or more internal stiffeners to prevent the collapse thereof when in tube form and stacked. Numerous embodiments are envisioned although only a limited number of alternatives is specifically disclosed.

22 Claims, 4 Drawing Sheets

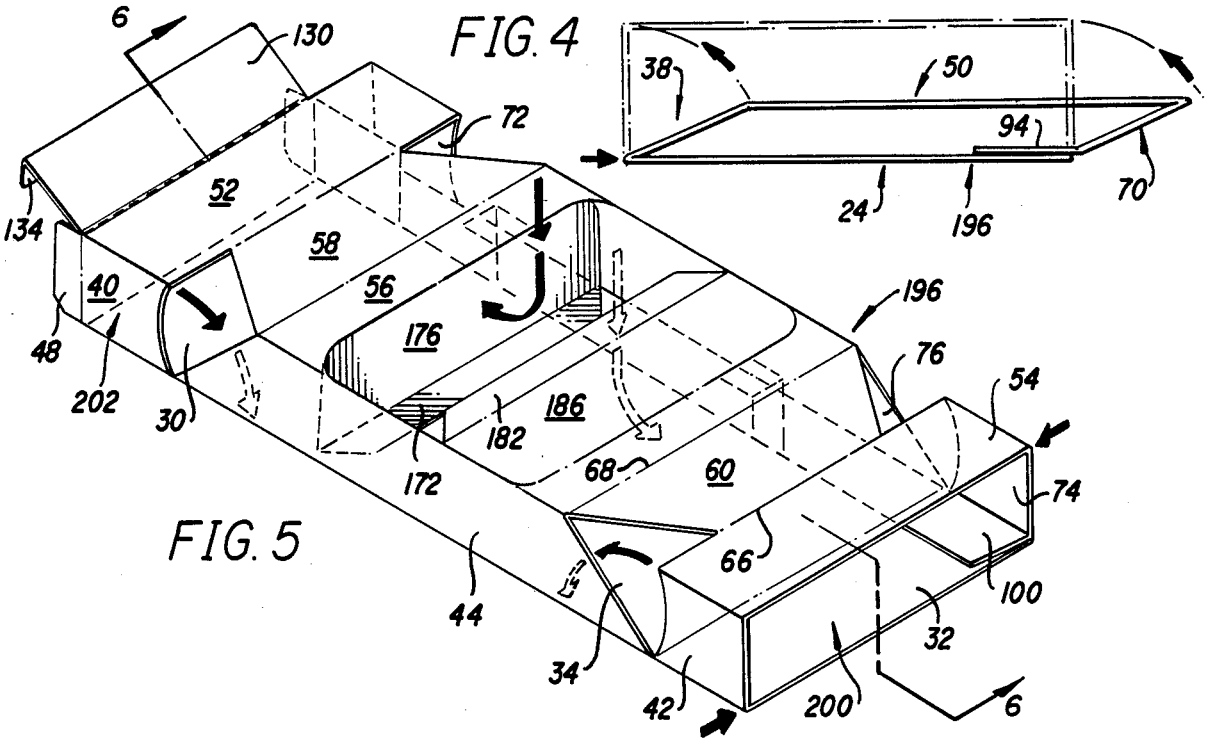
FIG. 4
FIG. 5
6
130
72
52
134
58
40
56
48
202
30
176
186
182
172
68
60
196
76
54
74
66
100
44
32
34
42
200
6
38
50
94
24
196
70
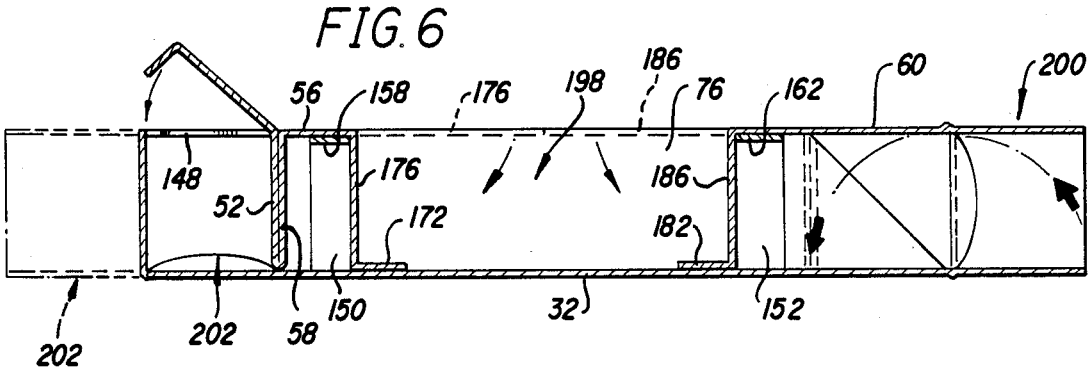
FIG. 6
56
158
176
198
186
76
162
60
200
148
52
176
172
186
182
202
202
58
150
32
152
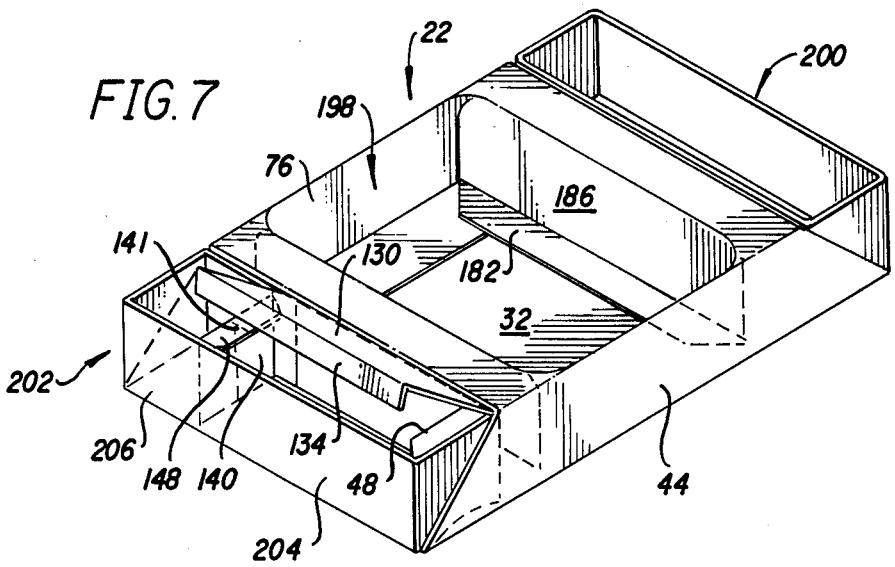
FIG. 7
22
200
198
76
186
141
130
182
32
202
206
148
140
134
48
44
204

FIG. 8
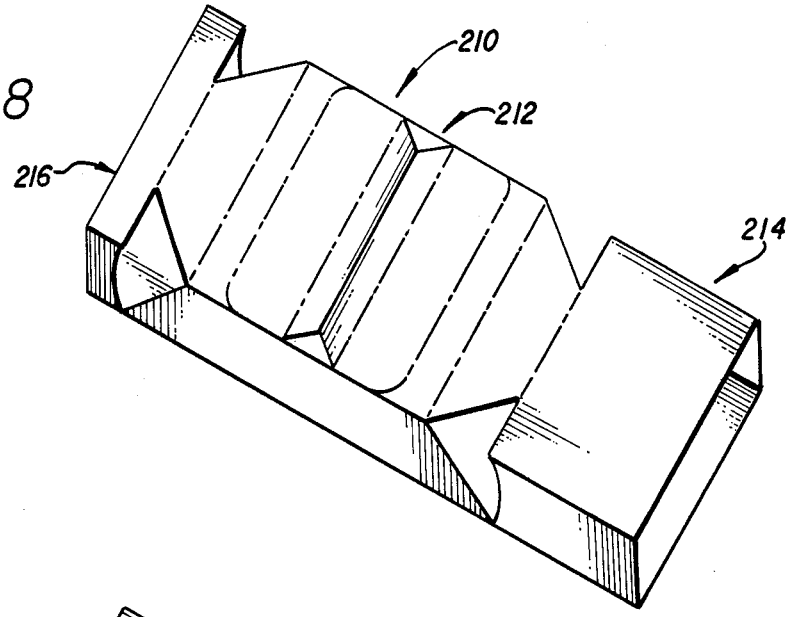
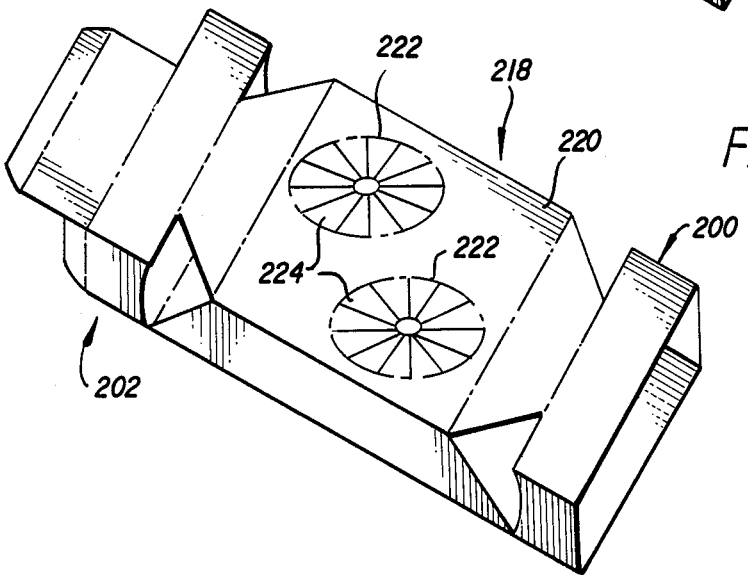
FIG. 9
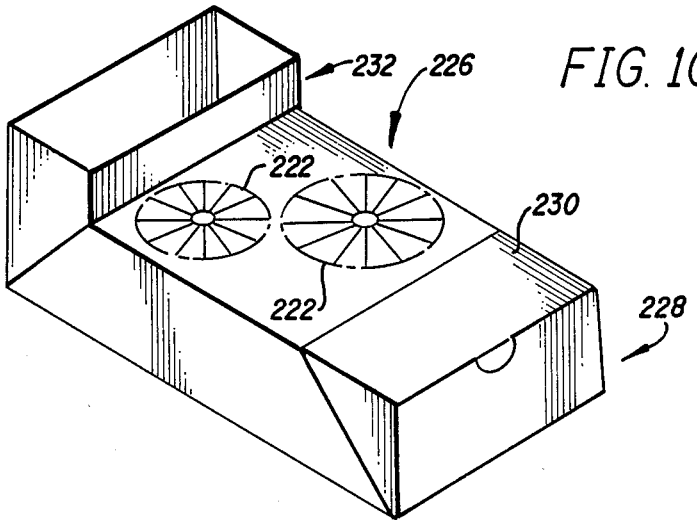
FIG. 10

FIG. 11
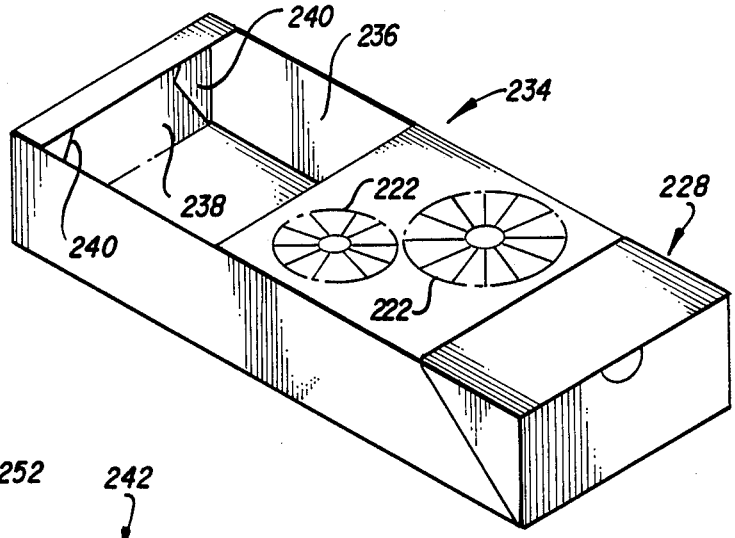
FIG. 12
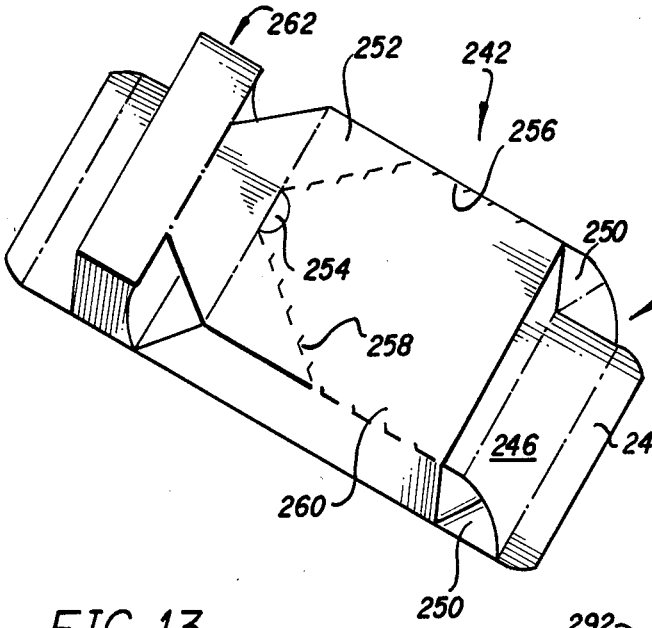
FIG. 13
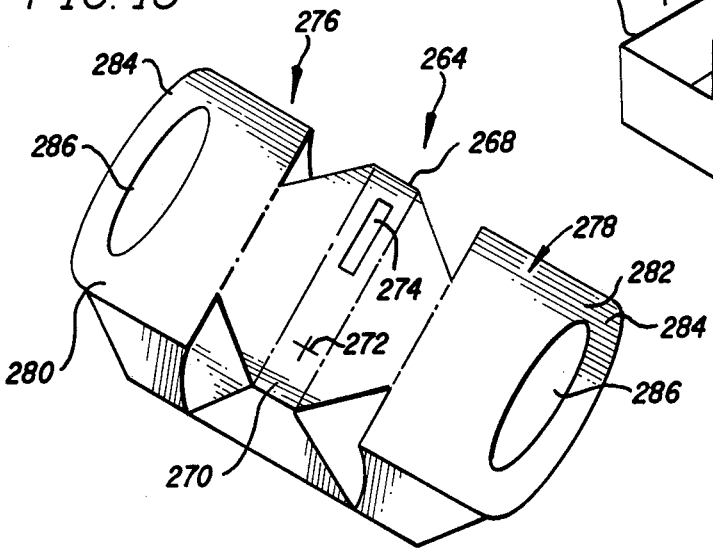
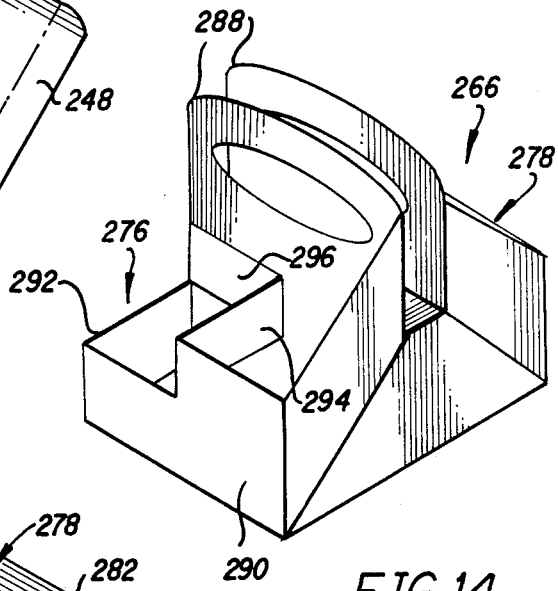
FIG. 14

TUBE CONSTRUCTION FOR FOOD AND BEVERAGE TRAY

This invention relates to new and useful improvements in food beverage trays for use by fast food establishments and the like, and more particularly to a tube construction which may be beneficially utilized in the formation of trays.

Most particularly, this invention relates to a tray which is provided in the form of a flattened tube which may be readily erected and which tube will have an end which is foldable to define an upright compartment in addition to a product receiving or dispensing opening in a top wall of the tube.

Another feature of the invention is that the tube may be provided with internal stiffeners so as to support the tube in its erected state in stacked relation. A further feature of the invention is that the basic tube may be modified as to the details of an opening in the top wall thereof, a receptacle aligned with that opening, and the size and type of compartments at one or both ends of the tube. With the above and other objects in view that will hereinafter appear, the nature of the invention will be more clearly understood by reference to the following detailed description, the appended claims, and the several views illustrated in the accompanying drawings.

FIG. 4 is a schematic end view of the tube showing the manner in which it is erected.

FIG. 5 is a top perspective view of the tube with one opening defining panel having been pressed out of the top wall to initiate the forming of a receptacle.

FIG. 6 is a longitudinal sectional view taken generally along the line 6—6 of FIG. 5 showing the internal construction of the tube with the center receptacle fully formed and a compartment at the left end being pivoted to its upright position.

FIG. 7 is a perspective view of the completed tray formed from the tube of FIG. 5.

FIGS. 8 and 9 are top perspective views showing modified forms of tubes for forming different configuration trays.

FIGS. 10 and 11 are top perspective views of modified forms of trays.

FIG. 12 is a top perspective view of tube for forming yet another form of tray.

FIG. 13 is a top perspective view of a further tube for forming still a further form of tray.

Figures 1, 2, 3:
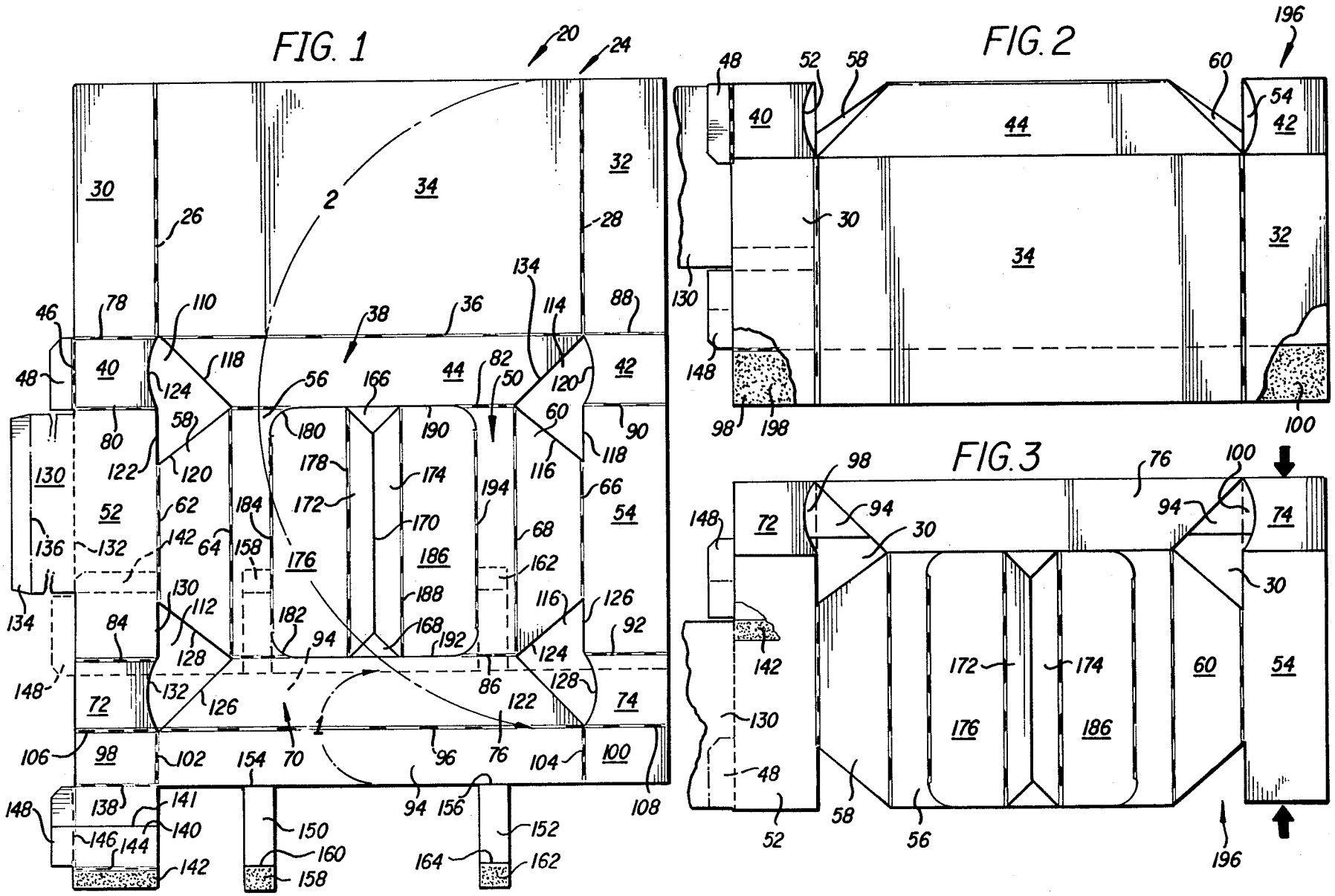
FIG. 1 is a plan view of a blank from which a first form of the invention is constructed.
FIG. 2 is a bottom plan view of a flat form tube resulting from the folding of the blank of FIG. 1 in accordance with the arrows found thereon, parts being broken away and shown in section.
FIG. 3 is a top plan view of the flat tube of FIG. 2 with parts broken away.

FIG. 14 is a top perspective view showing the tray which is formed from the tube of FIG. 13. Referring now to the drawings in detail, reference is first made to FIG. 1 wherein there is illustrated a blank, generally identified by the numeral 20, from which a tray 22 illustrated in FIG. 7 is formed. The blank 20 is formed of suitable paperboard and is generally rectangular in outline.

The blank 20 has at one side thereof a bottom wall 24 which is divided by transverse fold lines 26, 28 into outer panels 30, 32 and a central panel 34.

The bottom panel 24 is connected along a longitudinal fold line 36 to a side panel generally identified by the numeral 38. The side panel is divided by cut lines to be described hereinafter into small panels 40, 42, generally at the ends thereof and a central panel 44. The panel 40 carries along a transverse fold line 46 a closure flap 48.

The blank 20 also includes a top panel genrally identified by the numeral 50. The top panel 50 is also divided into a plurality of panels including narrower panels 52 and 54 at the opposite ends thereof and a relatively elongated central panel 56. The central panel 56 is connected to the panel 52 by a tapered connecting panel 58 while the panel 54 is connected to the central panel 56 by a tapered connecting panel 60. The connecting panel 58 is connected to the panel 52 along a transverse hinge line 62 and to the central panel 56 along a transverse fold line 64. In a like manner, the tapered connecting panel 60 is connected to the panel 54 along a transverse fold line 66 and to the central panel 56 along a transverse fold line 68.

The blank 20 includes a second side panel generally indicated by the numeral 70 which inludes short panels 72, 74 at the opposite ends of the blank and a central panel 76. These panels correspond to the panels 40, 42 and 44.

At this time it will be seen that the side panel 40 is joined to the panel 30 along a longitudinal fold line 78 which is an extension of the fold line 36. The panel 40 is joined to the panel 52 along a fold line 80 which is in alignment with a fold line 82 connecting the panels 44 and 56.

The panel 52 is connected to the panel 72 along a longitudinal fold line 84 which is in alignment with a fold line 86 connecting the panels 56 and 76.

The panel 42 is connected to the panel 32 along a fold line 88 which is also an extension of the fold line 36. The panel 42 is connected to the panel 54 along a fold line 90 which is longitudinally aligned with the fold line 82. The panel 54 is connected to the panel 74 along a longitudinal fold line 92 which is aligned with the fold line 86.

The blank 20 also includes a glue flap 94 which is connected to the panel 76 along a longitudinal fold line 96. At opposite ends of the glue flap 94 are glue flap portions 98 and 100 which are connected to the glue flap 94 along transverse fold lines 102 and 104, respectively. The glue flap extension 98 is connected to the panel 72 along a fold line 106 which is and extension of the fold line 96. The glue flap portion 100 is connected to the panel 74 along a fold line 108 which is also n extension of the fold line 96.

At this time it is pointed out that the blank 20 has four major cutouts therein, cutouts 110, 112, 114 and 116 which are of similar outlines and which are generally triangular. The cutout 110 is defined by a diagonal cut line 118 defining an end of the panel 44 and a digonal cut line 120 defining an end of the panel 58. The cutout 110 is also defined by a cut line 122 which extends along the panel 52 as an extension of the fold line 62 and an arcuate cut line 124 defining one edge of the panel 40.

The cutout 112 is defined by a straight cut line 126 which extends diagonally between the ends of the fold lines 102, 64 and defines one end of the panel 76. A second diagonal cut line 128 defines the second end of the panel 58. Cutout 126 is further defined by a straight cut line 130 which is a continuation of the fold line 62 and defines a portion of the panel 52. An arcuate cut line 132 forms generally a continuation of the cut line 130 and defines a side of the panel 72.

The cutout 114 is defined by a diagonal cut line 134 which defines an opposite edge of the panel 44. A second diagonal cut line 116 difines one end of the connecting panel 60. The opposite side of the cutout 114 is in part defined by straight cut line 118 which is an extension of the fold line 66 and defines an edge portion of the panel 54. An arcuate cut line 120 forms a continuation of the cut line 118 and further and edge of the panel 42.

With respect to the cutout 116, it is in part defined by a diagonal cut line 122 which forms the opposite end of the panel 76. In a like manner, a diagonal cut line 124 forms the opposite end of the panel 60. The generally triangular cutout 116 is further defined by a straight cut line portion 126 which forms an extension of the fold line 66 and an edge portion of the panel 54. An arcuate cut line 128 is a continuation of the cut line 126 and further defines one side of the panel 74.

The blank 20 further includes a closure panel 130 which is connected to the panel 52 along a transverse fold line 132. The closure panel 130, in turn, carries a tuck flap 134 which is connected thereto along a fold line 136.

The glue flap portion 98 has connected thereto along a longitudinal fold line 138 a stiffening panel 140 which is provided at its opposite edge with a glue flap 142 connected thereto along a longitudinal fold line 144. The stiffening panel 140 carries along a transverse fold line 146 a further closrure flap 148. The stiffening panel 140 and the adjacent closure flap 148 have a longitudinal scored relief line 141 extending across the panels. The longitudinal scored relief line 141 permits the stiffening panel 140 and the closure flap 148 to bow slightly during subsequent erection of the food and beverage tray which will be discussed later in the specification.

Further, if desired, the blank 20 may include two stiffening straps 150, 152 which extend transversely of the blank 20 and are connected to the glue flap 94 along longitudinal fold lines 154, 156, respectively.

The free end of the stiffening strap 150 is provided with a glue flap 158 which is connected thereto along a longitudinal fold line 160. In a like manner, the stiffening strap 152 carries a glue flap 162 which is connected thereto along a longitudinal fold line 164.

The top panel 56 is intended to have a product receiving opening therein. To this end, there are cutouts 166, 168 which are joined by a transverse cut line 170. The cut line 170 separates two flaps 172, 174. The flap 172 is carried by a panel 176 along a transverse fold line 178. The panel 176 is defined in part by cut lines 180, 182 having straight portions which are aligned with the fold lines 82, 86, respectively and by a transverse fold line 184 joining the cut lines 180, 182.

In a like manner, the flap 174 is carried by a panel 186 along a transverse fold line 188. The panel 186 is defined in part by cut lines 190, 192 which have curved and straight portions and the straight portions are in alignment with the fold lines 82, 86. The cut lines 190, 192 are joined by a transverse fold line 194.

It is to be understood that the blank 20, as illustrated in FIG 1, is viewed from the interior surface of the resultant tray 22.

The blank 20 is formed into a flat tube, generally identified by the numeral 196 by first folding the glue flap 94 and the components carried thereby along the fold line 96. At this time, the glue flap 142 becomes bonded to the underside of the panel 52 while the glue flaps 158, 162 become bonded to the underside of the panel 56. This folding is indicated by the arrow 1. Then the blank 20 is folded along the longitudinal fold lines 80, 82, 90 so that the free edges of the panels 30, 34, 32 are brought against the adhesive 198 on the panels 98, 94, 100 and are bonded to those panels. The flat tube 196 appears in FIG. 2.

The flat tube 196 is illustrated in FIG. 3 in a position inverted from that of FIG. 2 wherein the top thereof is uppermost. The flat tube is now ready for erection.

As shown most specifically in FIG. 4, the flat tube 196 is erected into its tubular configuration by pressing together the opposite edges of the flattened tube 196. Once the tube is erected, it is initially held in its upright position by the stiffening panel 140 and also the stiffening straps 150, 152, if utilized. The forming of the tray is now initiated by depressing the panel 176, 186 so that they are in upright positions, as shown in FIG. 6 with their flaps 172, 182 being wedged against the bottom wall 32 as is also shown in FIG. 6. When the stiffening straps 150, 152 are utilized, the panels 176, 186 will be brought into abutting engagement therewith. A receptacle 198 for a salad or the like is now formed. The partially formed tray 22 now has sufficient strength so that the trays may be stacked in their partially erected forms.

The right end of the tube 196 forms an upstanding compartment 200. The compartment 200 is defined by the panels 32, 42, 54, 74 and the glue flap 100.

It will be seen that since the bottom panel 32 is directly hinged to the bottom 34 along the fold line 28, the compartment 200 may be pivoted relative to the remainder of the tube as is schematically shown in FIG. 6. When this occurs, the connecting panel 60 folds along fold lines 66, 68 to an upright position while the compartment 200 pivots from a horizontal position to a vertical position between the ends of the side panels or walls 44, 76. The connecting panel 60 will retain the compartment 200 in its upright position. It will be understood that the bottom wall 34 forms the bottom of the compartment 200.

At the opposite end of the tubes 196, there is a compartment 202 which initially is also in a horizontal position. The compartment 202 is defined by a bottom panel 30, side panel 40, top panel 52 and side panel 72. The panels are bonded together by the glue flap 98 which is bonded to the panel 30. It is also to be noted that the panel 30 is directly hinged to the bottom wall or panel 34 while the panel 52 is connected to the top wall 56 by the connecting panel 58.

The tray 22 is generally completed by pivoting the compartment 202 to an upright position with the connecting panel 58 generally locking it in an upright position. This is shown in FIG. 6. During the pivoting movement of the compartment 202 to an upright position, the stiffening panel 140 and the closure flap 148 bow slightly to relieve the stress on the panel 52. The bottom wall 32 now becomes the bottom of the compartment 202.

It is to be noted that the compartment 202 is divided into two parts by the stiffening panel 140, as is best shown in FIG. 7. Preferably there is a wide part 204 and a narrow part 206. The narrow part 206 is open while the wide part 204 is preferably provided with the closure panel 130. After the desired product is placed within the compartment portion 204, it is closed by folding over the closure flaps 48, 148 and then folding down the closure panel 130 with the tuck flap 134 carried thereby engaging and locking with the closure flaps 48, 148.

The tray 22 is specifically designed to have, for example, a salad placed in the receptable 198, condiments in the compartment 200, meat products in the compartment portion 204 and sauce for the meat products in compartment portion 206. However, it is to be understood that the tray may be modified depending upon the food or drink products to be dispensed.

Reference is now made to FIG. 8 wherein there is illustrated a tube 210 particularly configurated to provide open compartments at opposite ends of a tray. The tube 210 will be generally of the same construction as the tube 196 with the central portion of the tube being configurated to defiene a receptacle 212. At the right end of the tube 210 there is a relatively deep compartment 214 and at the left end there is a relatively shallow compartment 216. It is to be understood that the compartments 214, 216 will be pivoted to their upright positions for receiving products. The compartment 214, being relatively deep, may receive as an example french fries, sandwiches and the like, whereas the compartment 216, being guite shallow, would receive condiments.

In FIG. 9 there is illustrated a tube, generally identified by the numeral 218 which is particularly adapted to be used in conjunction with drinks in cup. In lieu of the receptacle in the trays previously described, the central portion of the tube 218 has formed in a top wall 220 thereof openings 222 for receiving cups of drinks. Each opening 222 is defined by a plurality of fingers 224 which fold inwardly and downwardly when a cup is pressed into place. The fingers 224 grip the cup and securely hold it within the resultant tray.

The tube 218 is otherwise constructed the same as the tube 196 with there being a compartment 200 at the right end and a compartment 200 at the right end and a compartment 202 at the left end.

In FIG. 10 there is illustrated a modification of the tray formed from the tube 218, the illustrated tray being generally identified by the numeral 226. The central portion of the tray 226 is provided with the openings 222 for receiving drink cups. At the right end of the tray 222, there is a compartment generally identified by the numeral 228. The compartment 228 extends entirely across the tray and is provided with a hinged closure 230 similar to the closure for the compartment portion 204.

At the left end of the tray 226, there is an upwardly opening compartment generally identified by the numeral 232. The compartment 232 is of a height greater than the tray proper.

It is to be understood that a variety of foods may be placed in the compartments 228, 232.

Referring now to FIG. 11, it will be seen that there is illustrated a tray generally identified by the numeral 234. The tray 234 is similar to the tray 226 in that it is provided with a central portion having cup receiving openings 222 therein and the right end of the tray is in the form of a compartment like the compartment 228. However, the left part of the tray 234 is in the form of an open receptacle 236 with the free end of the tube from which the tray 234 is formed having that end thereof closed by a closure panel 238 and suitable closure flaps 240.

Reference is now made to FIG. 12 wherein there is illustrated a tube, generally identified by the numeral 242, for forming still another form of tray. The tray to be formed by the tube 242 is primarily intended to receive a sandwich. Accordingly, the right end of the tube 242 is provided with a closure assembly 244 for closing the same after a sandwich or the like has been inserted into the resultant tray. The closure assembly includes a closure panel 246 wich is hinged to the bottom wall of the tube. The closure panel 246 carries a tuck flap 248. There are also closure flaps 250 extending between the ends of the closre panel 246 and the ends of the side wall of the tube.

The tube 242 has a top wall 252 which is intended to be open to form a receptacle. To this end, the top wall 252 is provided at one end thereof with a finger opening 254. Weakening lines 256, 258 extended from the finger opening 254 in diverging relation until they reach the edges of the top wall 252 so as to define a displaceable panel 260. The resultant receptacle is usable, after the sandwich or the like has been removed so as to faciliate eating of the food products dispensed in the tray.

At the left end of the tube 242, there is a closable compartment, generally identified by the numeral 262. The compartment 262 will be the mirror image of the compartment 228.

In FIG. 13 there is illustrated a tube generally identified by the numeral 264, for forming a tray 266 which is illustrated in FIG. 14. The tube 264 has a very narrow central portion 268 including a top wall 270. The top wall 270 may have suitable openings, such as an opening 272 for a straw and an opening 274 for condiments, such as salt, pepper, ketchup, etc. At opposite ends of the central portion 268 of the tube 264, there are compartments 276, 278. The compartments, when folded to their upright positions, have open tops. However the compartments 276, 278 differ from previously described compartments in that wall portions 280, 282 thereof which are initially top walls portions, have extensions 284 with finger openings 286 so as to define handles. The resultant handles, identified by the numeral 288, are spaced apart in the tray 266 as is clearly shown in FIG. 14.

The details of the compartments 276, 278 may be varied in accordance with the product to be dispensed. For example, by cutting a portion of an initial bottom panel 290 and a side panel 292, straps 294, 296 may be formed and rotated 90 degrees with the strap 294 becoming a divider for the compartmetn 276. Depending upon the size of the tray 266, the divided compartment 276 could even receive drindk cups.

The compartment 274 may or may not be divided and may receive various food products including sandwiches, french fries and the like.

It will be readily apparent from the foregoing, that by utilizing the basic tube construction, which may be shipped and stored in a flat state and which is readily erectible, one may obtain a variety of trays of different capacities.

Although only several preferred embodiments of the resultant tray have been specifically illustrated and described herein, it is to be understood that minor variations may be made in the tray configuration without departing from the spirit and scope of the invention as defined by the appended claims, as is required for the dispensing of selected products.

I Claim:

1. A tray for use by fast food establishments and the like, said tray being in the form of an elongated tube including a bottom wall, a top wall and two side walls, said tray including at least one product opening in said top wall, at least one compartment having a product receiving opening therein connect to one end of said tube, and fold means in said bottom wall and said top wall for connecting said compartment to the remainder of said tube, for pivoting said compartment to an upstanding position relative to the remainder of said tube so that said compartment product opening has the same orientation as said top wall product opening.

2. A tray according to claim 1 wherein said fold means includes a transverse fold line in said bottom wall, two transverse fold lines in said top wall, and cutouts in said side walls and said top wall.

3. A tray according to claim 2 wherein each of said top wall cutouts is immediately adjacent to an associated side wall cutout.

4. A tray according to claim 3 wherein each of said top wall cutouts is immediately adjacent to an asociated side wall cutout, and each of said cutouts being triangular in outline.

5. A tray according to claim 3 wherein each of said top wall cutouts is immediately adjacent to an associated side wall cutout, and each of said cutouts being triangular in outline and converging together to a point.

6. A tray according to claim 1 wherein said tube has a flat storage state.

7. A tray according to claim 1 wherein said tube has a flat storage state and in the open state of said tube, there is a stiffening panel extending between said bottom wall and top wall intermediate said side walls for maintaining said tube in an erected state.

8. A tray according to claim 7 wherein said stiffening panel is in said compartment and divides said compartment into two parts.

9. A tray according to claim 7 wherein there are two of said stiffening panels, said stiffening panels extending transversely of said tube.

10. A tray according to claim 7 wherein there are two of said stiffening panels, said stiffening panels extending transversely of said tube and defining end walls of a receptacle aligned with said one product opening.

11. A tray according to claim 9 together with a further stiffening panel extending longitudinally and betwen said top and bottom walls immediately adjacent each of said transversely extending stiffening panels.

12. A tray according to claim 7 wherein there is a glue flap carried by one of said side walls and overlying and bonded to an edge portion of said bottom wall, and said stiffening panel is an extension of said glue flap.

13. A tray according to claim 1 wherein said compartment has a closure flap.

14. A tray according to claim 1 wherein there is a second compartement at the opposite end of said tube, and other fold means connecting said other compartment to the remainder of said tube for pivoting to an upstanding position, said compartments being of the same longitudinal extent and of a length corresponding to the height of said tube side walls whereby tops of said pivoted compartments are substantially flush with said top wall.

15. A tray according to claim 1 wherein said pivoted compartment has a bottom defined by said tube bottom wall and upright transverse walls formed by said tube top and bottom wall.

16. A tray according to claim 1 wherein said product receiving opening is as a result of transversely extending panels being folded into said tube with said tube bottom wall, portions of said tube side walls and said transversely extending panels defining a receptacle aligned with said opening.

17. A tray according to claim 1 wherein there is a second compartment at the opposite end of said tube, and other fold means connecting said other compartment to the remainder of said tube for pivoting to an upstanding position, said compartments being of different longitudinal extents whereby said pivoted compartments are of different heights.

18. A tray according to claim 1 whrein said product receiving opening is defined by a plurality of fingers for grasping such product.

19. A tray according to claim 1 wherein there are two of said product openings, one for receiving containers and one for receiving a loose product.

20. A tray according to claim 1 wherein said tube is closed at that end thereof remote from said compartment and forms a receptacle for a sandwich or the like, and said opening is initially closed by a removable flap.

21. A tray according to claim 1 wherein there is a second compartment at the opposite end of said tube, and other fold means connecting said other compartment to the remainder of said tube for pivoting to an upstanding position, said compartments being of the same longitudinal extent and having extensions of said top wall defining cooperating handles in the pivoted upstanding positions of said compartments.

22. A tray according to claim 1 wherein said fold means includes a transverse fold line in said bottom wall, two transverse fold line in said top wall, and cutouts in said side walls and said top wall extending between said fold lines.

* * * * *